US009465342B2

(12) United States Patent
Fukami

(10) Patent No.: US 9,465,342 B2
(45) Date of Patent: Oct. 11, 2016

(54) IMAGE FORMING APPARATUS

(71) Applicant: KYOCERA Document Solutions Inc., Osaka (JP)

(72) Inventor: Mariko Fukami, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 14/974,440

(22) Filed: Dec. 18, 2015

(65) Prior Publication Data

US 2016/0187828 A1 Jun. 30, 2016

(30) Foreign Application Priority Data

Dec. 26, 2014 (JP) ..... 2014-265932

(51) Int. Cl.

*G03G 15/00* (2006.01)
*G03G 15/02* (2006.01)
*G03G 21/00* (2006.01)

(52) U.S. Cl.

CPC ..... *G03G 15/55* (2013.01); *G03G 15/502* (2013.01); *G03G 15/553* (2013.01); *G03G 15/0225* (2013.01); *G03G 21/0005* (2013.01); *G03G 2215/1652* (2013.01)

(58) Field of Classification Search

CPC ..... G03G 15/55
See application file for complete search history.

(56) References Cited

U.S. PATENT DOCUMENTS

2009/0297174 A1* 12/2009 Soures ..... G03G 15/55 399/18

FOREIGN PATENT DOCUMENTS

JP 2007-074290 A 3/2007

* cited by examiner

*Primary Examiner* — Minh Phan
*Assistant Examiner* — Victor Verbitsky
(74) *Attorney, Agent, or Firm* — IP Business Solutions, LLC

(57) ABSTRACT

An image forming apparatus includes: an image formation section, a display section, an abnormal image information reception section, a cause specification section, and an operation control section. The abnormal image information reception section causes display of the image data at an operation section and also receives, from a user, specification of a position and a kind of an abnormal image appearing on recording paper on which an image has been formed by the image formation section. The cause specification section specifies a cause of the appearance of the abnormal image based on the position and the kind of the abnormal image received by the abnormal image information reception section. The operation control section controls a cleaning section cleaning each driving section of the image formation section to make the cleaning section perform a predefined cleaning operation in correspondence with the cause specified by the cause specification section.

3 Claims, 8 Drawing Sheets

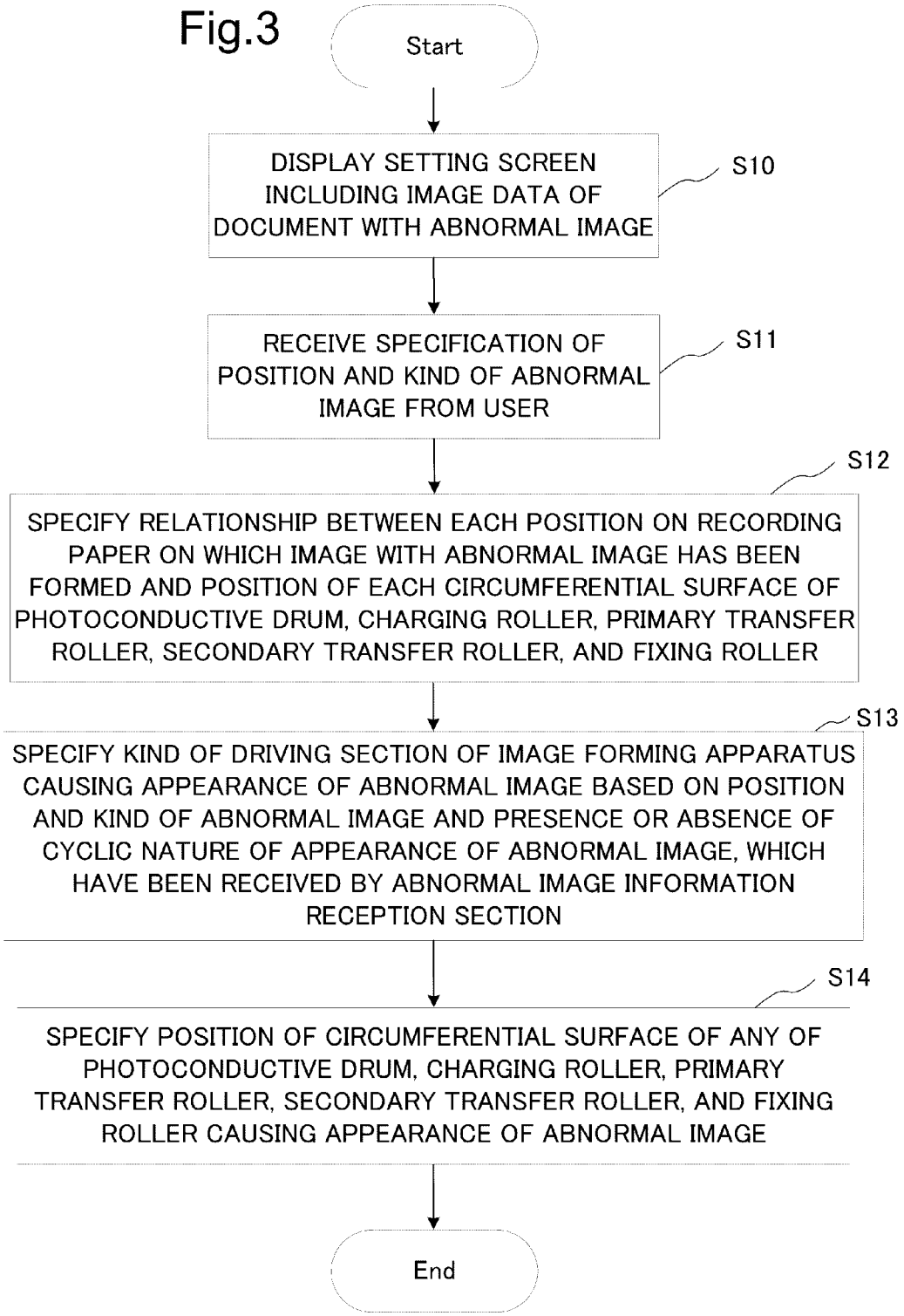
Fig.3
Start
DISPLAY SETTING SCREEN INCLUDING IMAGE DATA OF DOCUMENT WITH ABNORMAL IMAGE
S10
RECEIVE SPECIFICATION OF POSITION AND KIND OF ABNORMAL IMAGE FROM USER
S11
S12
SPECIFY RELATIONSHIP BETWEEN EACH POSITION ON RECORDING PAPER ON WHICH IMAGE WITH ABNORMAL IMAGE HAS BEEN FORMED AND POSITION OF EACH CIRCUMFERENTIAL SURFACE OF PHOTOCONDUCTIVE DRUM, CHARGING ROLLER, PRIMARY TRANSFER ROLLER, SECONDARY TRANSFER ROLLER, AND FIXING ROLLER
S13
SPECIFY KIND OF DRIVING SECTION OF IMAGE FORMING APPARATUS CAUSING APPEARANCE OF ABNORMAL IMAGE BASED ON POSITION AND KIND OF ABNORMAL IMAGE AND PRESENCE OR ABSENCE OF CYCLIC NATURE OF APPEARANCE OF ABNORMAL IMAGE, WHICH HAVE BEEN RECEIVED BY ABNORMAL IMAGE INFORMATION RECEPTION SECTION
S14
SPECIFY POSITION OF CIRCUMFERENTIAL SURFACE OF ANY OF PHOTOCONDUCTIVE DRUM, CHARGING ROLLER, PRIMARY TRANSFER ROLLER, SECONDARY TRANSFER ROLLER, AND FIXING ROLLER CAUSING APPEARANCE OF ABNORMAL IMAGE
End

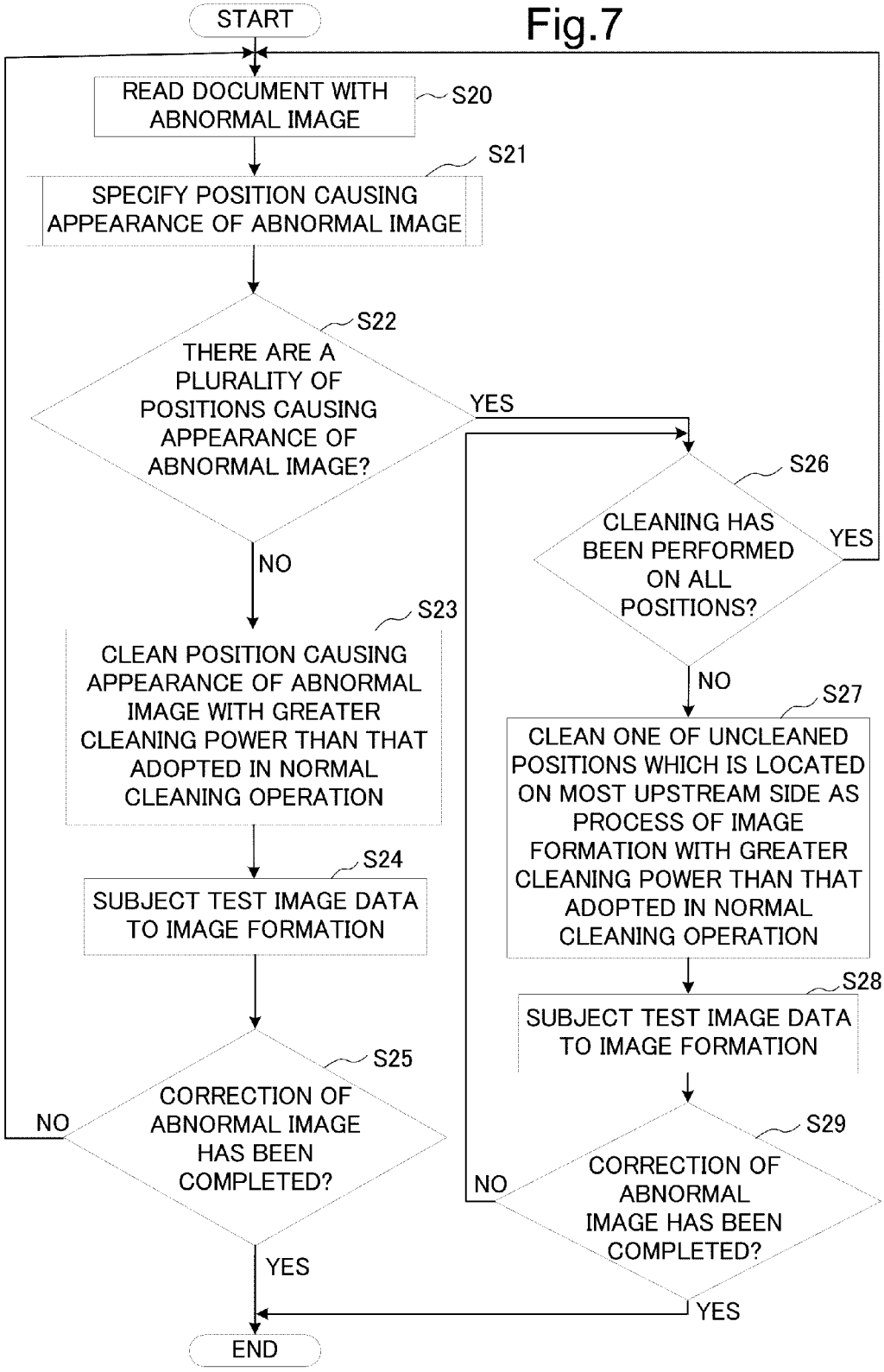
Fig.7
START
READ DOCUMENT WITH ABNORMAL IMAGE
S20
S21
SPECIFY POSITION CAUSING APPEARANCE OF ABNORMAL IMAGE
S22
THERE ARE A PLURALITY OF POSITIONS CAUSING APPEARANCE OF ABNORMAL IMAGE?
YES
NO
S23
CLEAN POSITION CAUSING APPEARANCE OF ABNORMAL IMAGE WITH GREATER CLEANING POWER THAN THAT ADOPTED IN NORMAL CLEANING OPERATION
S24
SUBJECT TEST IMAGE DATA TO IMAGE FORMATION
S25
CORRECTION OF ABNORMAL IMAGE HAS BEEN COMPLETED?
NO
YES
END
S26
CLEANING HAS BEEN PERFORMED ON ALL POSITIONS?
YES
NO
S27
CLEAN ONE OF UNCLEANED POSITIONS WHICH IS LOCATED ON MOST UPSTREAM SIDE AS PROCESS OF IMAGE FORMATION WITH GREATER CLEANING POWER THAN THAT ADOPTED IN NORMAL CLEANING OPERATION
S28
SUBJECT TEST IMAGE DATA TO IMAGE FORMATION
S29
CORRECTION OF ABNORMAL IMAGE HAS BEEN COMPLETED?
NO
YES

IMAGE FORMING APPARATUS

INCORPORATION BY REFERENCE

This application claims priority to Japanese Patent Application No. 2014-265932 filed on Dec. 26, 2014, the entire contents of which are incorporated by reference herein.

BACKGROUND

This disclosure relates to a technology of resolving a problem occurring on an image monitored, in particular outputted by an image forming apparatus.

In a case where a problem such as a black spot has occurred on an image outputted from the image forming apparatus, a cause of this problem needs to be specified to resolve the image.

Thus, suggested has been a technology of specifying a problem occurring on an outputted image through comparison between test reference image data and image data to be tested, which data was obtained by optically reading an image outputted through image formation of the reference image data, and also specifying a cause of the specified problem through its analysis.

SUMMARY

As one aspect of this disclosure, a technology obtained by further improving the technology described above will be suggested.

An image forming apparatus according to one aspect of this disclosure includes: an image formation section, a display section, an abnormal image information reception section, a cause specification section, cleaning section, and an operation control section.

The image formation section performs image formation of image data.

The display section displays the image data.

The abnormal image information reception section causes display of the image data at the display section and also receives, from a user, specification of a position and a kind of an abnormal image appearing on recording paper on which an image has been formed by the image formation section.

The cause specification section specifies a cause of the appearance of the abnormal image based on the position and the kind of the abnormal image received by the abnormal image information reception section.

The cleaning section cleans each driving section of the image formation section. and The operation control section makes the cleaning section perform a predefined cleaning operation in correspondence with the cause specified by the cause specification section.

BRIEF DESCRIPTION OF THE DRAWINGS

FIG. 3 is a flowchart showing a flow of processing of specifying a position causing appearance of an abnormal image in the image forming apparatus according to one embodiment of this disclosure;

FIG. 7 is a flowchart showing a flow of processing of specifying and resolving a problem in the image forming apparatus according to one embodiment of this disclosure.

DETAILED DESCRIPTION

Figure 1:
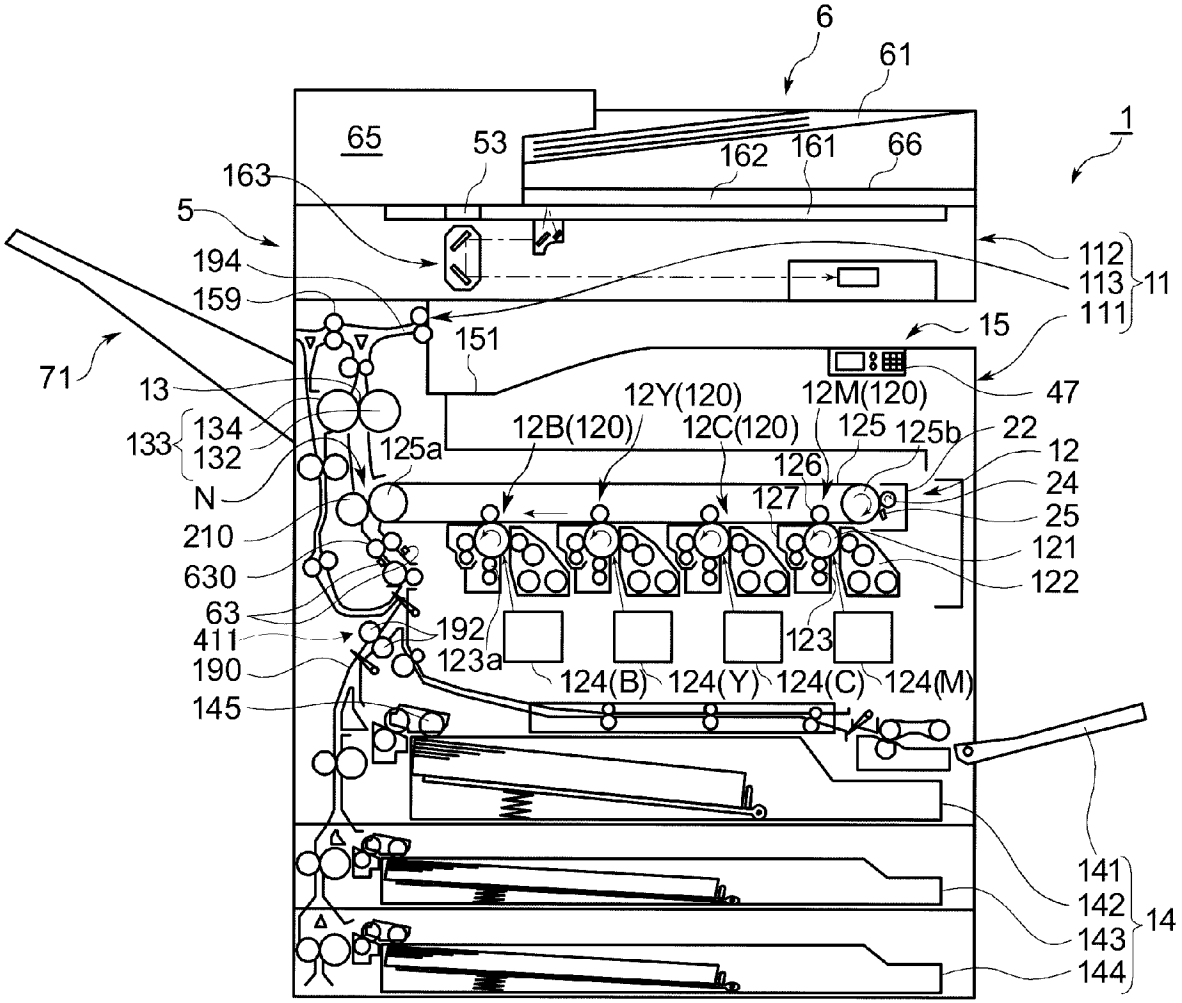
FIG. 1 is an elevation sectional view showing a structure of an image forming apparatus according to one embodiment of this disclosure.

Hereinafter, an image forming apparatus according to one embodiment of this disclosure will be described with reference to the drawings. FIG. 1 is an elevation sectional view showing a structure of the image forming apparatus according to one embodiment of this disclosure.

As shown in FIG. 1, an image forming apparatus 1 according to one embodiment of this disclosure is a multifunction peripheral combining a plurality of functions such as, for example, a copy function, a printer function, a scanner function, and a facsimile function. The image forming apparatus 1 includes, in an apparatus main body 11: an operation section 47, an image formation section 12, a fixing section 13, a paper feed section 14, a document feed section 6, a document reading section 5, etc.

The apparatus body 11 includes: a lower main body 111; an upper main body 112 arranged above this lower main body 111 oppositely thereto; and a coupling section 113 provided between these lower main body 111 and upper main body 112. The coupling section 113 is a structure for coupling the lower main body 111 and the upper main body 112 to each other in a state in which a paper discharge section 15 is formed therebetween, is provided upright from a left part and a rear part of the lower main body 111 in FIG. 1, and is formed into an L shape in a plan view. The upper main body 112 is supported at an upper end part of the coupling section 113. Provided in the upper main body 112 are the document reading section 5 and the document feed section 6.

The document reading section 5 includes: contact glass 161 (document stand) which is fitted at an opening at a top of the upper main body 112 for the purpose of loading a document; a document press cover 162 of an openable and closable type which presses a document loaded on this contact glass 161; and a reading mechanism 163 which reads an image of the document loaded on the contact glass 161. The image reading section 163 optically reads the image of the document by use of an image sensor such as a charge coupled device (CCD) or a complementary metal oxide semiconductor (CMOS) to generate image data.

The document feed section 6 includes: a document loading stand 61 on which documents are loaded; a document discharge section 66 to which the image-read document is discharged; and a document conveyance mechanism 65. The document conveyance mechanism 65 includes a paper feed roller, a conveyance roller, and a paper inversion mechanism, not shown. The document conveyance mechanism 65, as a result of driving of the paper feed roller and the conveyance roller, individually feeds the documents loaded on the document loading stand 61 and conveys them to a position opposing a document reading slit 53 to allow them to be ready by the reading mechanism 163 through the document reading slit 53, and then discharges them to the document discharge section 66. Moreover, the document conveyance mechanism 65, by making the paper inversion mechanism invert sides of the document and then conveying the document again to the position opposing the document reading slit 53, makes it possible to read images on the both sides of this document by the image reading section 163 through the document reading slit 53.

Further, the document feed section 6 is provided turnably with respect to the upper main body 112 in a manner such that its front side is movable upward. By moving the front side of the document feed section 6 upward and opening a top surface of the contact glass 161 as a document stand, a document to be read, for example, a two-faced book can be loaded on the top surface of the contact glass 161 by a user.

Fitted inside of the lower main body 111 are: the image formation section 12, the fixing section 13, and the paper feed section 14. Provided in the upper main body 112 is the document reading section 5. The paper feed section 14 has paper feed cassettes 142, 143, and 144 that can be inserted and detached into and from the apparatus body 11. On the paper feed cassettes 142, 143, and 144, bundles of paper formed by superposing pieces of recording paper (one example of a recording medium) on one another are respectively stored. For example, stored on the paper feed cassette 142 is non-printed recording paper with both blank surfaces, and stored on the paper feed cassette 143 is used paper (backing paper) on only one side of which is printed and another side of which is not printed and thus blank. In this embodiment, three levels of the paper feed cassettes 142, 143, and 144 are provided but more than three levels of the paper feed cassettes may be provided.

The image formation section 12 performs an image formation operation of forming a toner image on recording paper fed from the paper feed section 14. The image formation section 12 includes: a magenta image formation unit 12M using a toner of a magenta color; a cyan image formation unit 12C using a toner of a cyan color; an yellow image formation unit 12Y using a toner of an yellow color; and a black image formation unit 12Bk using a toner of a black color, which are sequentially arranged from an upstream side to a downstream side in a direction in which an intermediate transfer belt 125 runs; the intermediate transfer belt 125 stretched between a plurality of rollers such as a driving roller 125*a* (secondary transfer opposing roller) in a manner such as to endlessly run in a sub-scanning direction in the image formation; and a secondary transfer roller 210 abutting an outer circumferential surface of the intermediate transfer belt 125 at a portion where the intermediate transfer belt 125 is stretched around the driving roller 125*a*.

Each image formation unit 120 integrally includes: a photoconductive drum 121; a developing device 122 supplying a toner to the photoconductive drum 121; a toner cartridge (not shown) storing a toner; a charging device 123; an exposure device 124; a primary transfer roller 126; and a drum cleaning device 127.

The photoconductive drum 121 forms, on its circumferential surface, an electrostatic latent image and a toner image along this electrostatic latent image. The developing device 122 supplies a toner to the photoconductive drum 121. To each developing device 122, a toner is refilled from the toner cartridge as appropriate.

The charging device 123 is provided at a position immediately under the photoconductive drum 121. The charging device 123 has a charging roller 123*a*, and evenly charges the circumferential surface of each photoconductive drum 121.

The exposure device 124 is provided at a position below the photoconductive drum 121 and further below the charging device 123. The exposure device 124 irradiates the circumferential surface of the already charged photoconductive drum 121 with laser light corresponding to each color based on the image data inputted from, for example, a computer and the image data acquired by the document reading section 5, forming an electrostatic latent image on the circumferential surface of each photoconductive drum 121. The exposure device 124 is a so-called laser exposure device, which includes optical components such as a laser light source outputting a laser beam, a polygon mirror reflecting this laser beam towards a surface of the photoconductive drum 121, and a lens and a mirror for guiding laser light reflected by the polygon mirror to the photoconductive drum 121.

The developing device 122 supplies a toner to the electrostatic latent image on the circumferential surface of the photoconductive drum 121 rotating in a direction of an arrow to lay the toner thereon, and forms, onto the circumferential surface of the photoconductive drum 121, the toner image in accordance with the image data.

The intermediate transfer belt 125 is arranged at a position on an upside of each photoconductive drum 121. The intermediate transfer belt 125 is stretched between the driving roller 125*a* on a left side in FIG. 1 and a driven roller 125*b* on a right side in the same figure in such a manner as to be capable of endlessly running with its lower outer circumferential surface abutting the circumferential surface of each photoconductive drum 121. The driven roller 125*b* is provided at a position opposing the driving roller 125*a*, and rotates following the endless running of the intermediate transfer belt 125. The intermediate transfer belt 125 has an image carrying surface, on an outer circumferential surface of which the toner image is transferred, and is driven by the driving roller 125*a* while abutting the circumferential surface of the photoconductive drum 121. The intermediate transfer belt 125 endlessly runs between the driving roller 125*a* and the driven roller 125*b* in synchronization with each photoconductive drum 121.

Provided at a position opposing each photoconductive drum 121 with the intermediate transfer belt 125 in between is the primary transfer roller 126. To this primary transfer roller 126, a transfer bias is applied by a transfer bias application mechanism, not shown, and the primary transfer roller 126 transfers the aforementioned toner image, which has been formed on the outer circumferential surface of each photoconductive drum 121, onto a surface of the intermediate transfer belt 125.

Figure 2:
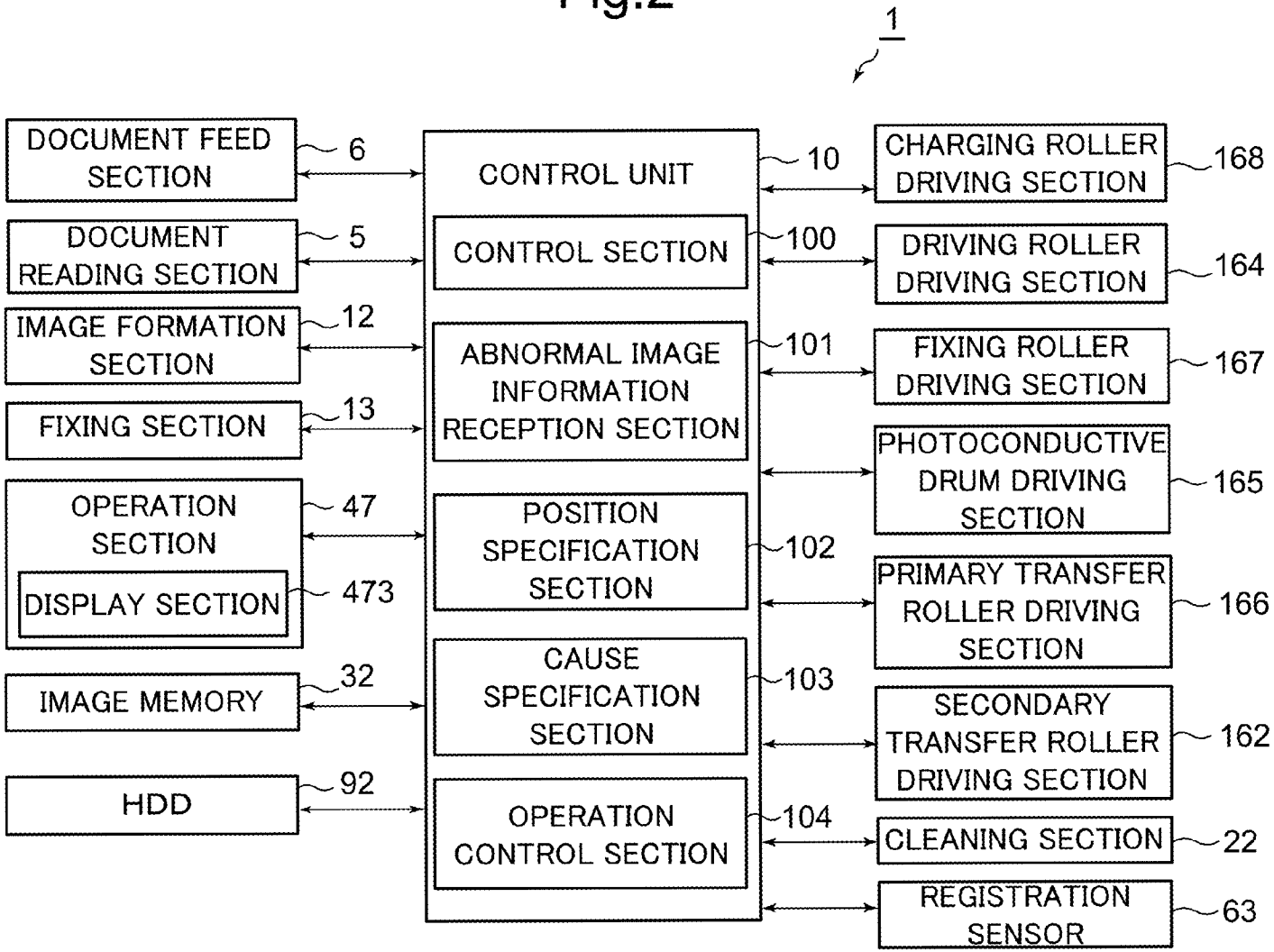
FIG. 2 is a functional block diagram schematically showing main inner configuration of the image forming apparatus according to one embodiment of this disclosure.

The driving roller 125*a* makes the intermediate transfer belt 125 endlessly run by a rotational driving force given from a driving motor (not shown) driven under control by a control section 100 (see FIG. 2).

The control section 100 (see FIG. 2) performs driving control of the primary transfer rollers 126 and the image formation units 120 for the respective colors, and causes transfer of the magenta toner image formed by the magenta image formation unit 12M on the surface of the intermediate transfer belt 125, then transfer of the cyan toner image formed by the cyan image formation unit 12C at the same position of the intermediate transfer belt 125, then transfer of the yellow toner image formed by the yellow image formation unit 12Y at the same position of the intermediate transfer belt 125, and finally transfer of the black toner image formed by the black image formation unit 12Bk in a manner such that the toner images of the respective colors are superposed on one another, thereby forming a color toner image on the surface of the intermediate transfer belt 125 (intermediate transfer (primary transfer)).

To the secondary transfer roller (transfer section) 210, a transfer bias is applied by the transfer bias application mechanism, not shown. The secondary transfer roller 210 transfers the aforementioned color toner image, which has been formed on the surface of the intermediate transfer belt 125, onto the recording paper conveyed from the paper feed section 14. The secondary transfer roller 210 is provided on a paper conveyance path 190 at the portion where the intermediate transfer belt 125 is stretched around the driving roller 125*a* while abutting the outer circumferential surface of the intermediate transfer belt 125. The secondary transfer roller 210 forms a nip part N, at which secondary transfer of the toner image onto the recording paper is performed, between the secondary transfer roller 210 and the driving roller 125*a* with the intermediate transfer belt 125 in between. The recording paper conveyed through the conveyance path 190 is pressed by the intermediate transfer belt 125 and the secondary transfer roller 210 and sandwiched therebetween, on which the toner image on the intermediate transfer belt 125 is secondarily transferred onto the recording paper.

Arranged upstream of the nip part N formed by the secondary transfer roller 210 and the driving roller 125*a* in a direction in which the recording paper is conveyed by a paper conveyance section (conveyance section) 411 is a registration roller 630. The registration roller 630, for example, put the conveyance of the recording paper on standby for the purpose of synchronization between timing at which the toner image is transferred from the intermediate transfer belt 125 by the secondary transfer roller 210 and timing at which the paper conveyance section 411 conveys the recording paper to the nip part N.

Arranged upstream of this registration roller 630 in the direction in which the recording paper is conveyed by the paper conveyance section 411 is a registration sensor 63.

The drum cleaning device 127 is provided at a left position of the photoconductive drum 121 in FIG. 1, and removes the residual toner on the circumferential surface of the photoconductive drum 121 for cleaning. The circumferential surface of the photoconductive drum 121 cleaned by this drum cleaning device 127 moves towards the charging device 123 again for new charging processing.

Formed at a left position in FIG. 1 with respect to the image formation section 12 is the conveyance path 190 extending vertically. Provided at an appropriate place on the conveyance path 190 is a conveyance roller pair 192. The conveyance roller pair 192 conveys the recording paper fed from the paper feed section 14 towards the nip part N and the fixing section 13. A conveyance mechanism formed of this conveyance roller pair 192 arranged at the appropriate place is one example of a conveyance section.

The fixing section 13 includes a fixing roller 133 having: a heating roller 132 including therein a current-carrying heat generating body as a heating source; and a pressure roller 134 arranged oppositely to the heating roller 132. The fixing section 13 performs fixing processing by supplying heat from the heating roller 132 to the toner image transferred on the recording paper at the image formation section 12 during passage of the recording paper through a fixing nip part between the heating roller 132 and the pressure roller 134. The recording paper on which the color toner image has already been formed and which has gone through the fixing processing is discharged through a discharged-paper conveyance path 194, which is so provided as to extend from a top part of the fixing section 13, towards a discharge tray 151 provided at a top of the lower main body 111.

Provided at a position opposing the outer circumferential surface of the intermediate transfer belt 125 stretched around the driven roller 125*b* is a cleaning section 22. The cleaning section 22 removes the residual toner remaining on the surface of the photoconductive drum 121 after the transfer of the toner image onto the recording paper. The cleaning section 22 includes: for example, a cleaning roller 24, a cleaning blade 25, a driving source, not shown, such as a motor and a decelerating gear.

The cleaning roller 24 is a cleaning member which removes the aforemetnioend residual toner while making contact with the surface of the intermediate transfer belt 125. The cleaning roller 24 is formed by, for example, foaming melanin resin, and is arranged oppositely to the driven roller 125*b* while kept in contact with the surface of the intermediate transfer belt 125. Moreover, the cleaning roller 24 is driven by the aforementioned driving source, not shown, into rotation in a manner such that a rotation direction of a circumferential surface of the cleaning roller 24 is opposite to the direction in which the intermediate transfer belt 125 runs. As a result, the cleaning roller 24, at its portion in contact with the intermediate transfer belt 125, scrapes away the residual toner firmly adhering to the surface of the intermediate transfer belt 125. The scraped residual toner is collected by the cleaning blade 25 arranged at a position on a downstream side in the direction in which the intermediate transfer belt 125 runs and also below the cleaning roller 24.

The paper feed section 14 includes: a manual feed tray 141 provided on a right side wall of the apparatus body 11 in FIG. 1 in an openable and closable manner; and the paper feed cassette 142 detachably fitted at a position below the exposure device 124 in the lower main body 111.

The manual feed tray 141 is a tray provided at a lower position on a right surface of the lower main body 111 for the purpose of feed recording paper towards the image formation section 12 through a manual operation. The paper feed cassettes 142 and 143 store the bundles of paper on which the plurality of sheets of recording paper are superposed. Provided above the paper feed cassette 142 is a pickup roller 145, which feeds, towards the conveyance path 190, the uppermost recording paper of the bundles of paper stored on the paper feed cassettes 142 and 143.

The paper discharge section 15 is formed between the lower main body 111 and the upper main body 112. The paper discharge section 15 includes the discharge tray 151 formed on a top surface of the lower main body 111. The discharge tray 151 is a tray to which the recording paper, on which the toner image has been formed at the image formation section 12, is discharged after subjected to the fixing processing at the fixing section 13.

Next, electrical configuration of the image forming apparatus 1 will be described. FIG. 2 is a functional block diagram schematically showing main inner configuration of the image forming apparatus 1.

The image forming apparatus 1 includes a control unit 10. The control unit 10 is composed of: a central processing unit (CPU), a RAM, a ROM, a dedicated hardware circuit, etc., and is in charge of overall operation control of the image forming apparatus 1.

The control unit 10 is connected to: the document feed section 6, the document reading section 5, the image formation section 12, the fixing section 13, the operation section 47, an image memory 32, a hard disc drive (HDD)

92, a driving roller driving section 164, a fixing roller driving section 167, a photoconductive drum driving section 165, a primary transfer roller driving section 166, a secondary transfer roller driving section 162, the cleaning section 22, the registration sensor 63, etc. The control unit 10 performs operation control of each of the aforementioned connected mechanisms and signal or data transmission and reception to and from each mechanism.

The control unit 10 includes the control section 100 in charge of the overall operation control of the image forming apparatus 1 described above. The control section 100 controls driving and processing of each mechanism section required for executing operation control for each of a scanner function, a printer function, and a copy function in accordance with an instruction for job execution inputted from the user, for example, through the operation section 47 or the network-connected personal computer.

The document reading section 5 includes the aforementioned reading mechanism 163 having a light irradiation section, a CCD sensor, etc. under てえ control by the control unit 10. The document reading section 5 irradiates a document by the light irradiation section and receives reflective light thereof with the CCD sensor, thereby reading an image from the document.

The image memory 32 is a region which temporarily stores data of a document image obtained through the reading by the document reading section 5 and temporarily saves data of the image formation section 12 to be printed.

The image formation section 12 performs image formation of, for example, print data read at the document reading section 5 and print data received from the network-connected computer.

The operation section 47, as shown in FIG. 1 in addition to FIG. 2, includes a touch panel section and an operation key section for receiving instructions, from the user, for various operations and processing executable by the image forming apparatus 1. The touch panel section includes a display section 473 such as a liquid crystal display (LCD) provided with a touch panel.

The HDD 92 is a large-capacity storage device which stores, for example, the document image read by the document reading section 5.

The driving roller driving section 164 includes a motor and a driver for rotationally driving the driving roller 125*a* around which the intermediate transfer belt 125 is stretched.

The photoconductive drum driving section 165 includes a motor and a driver for rotationally driving the photoconductive drum 121.

The primary transfer roller driving section 166 includes a motor and a driver for rotationally driving the primary transfer roller 126.

The secondary transfer roller driving section 162 includes a motor and a driver for rotationally driving the secondary transfer roller 210 which transfers, onto the recording paper, the toner image formed on the intermediate transfer belt 125. The transfer bias section is included in this secondary transfer roller driving section 162.

The fixing roller driving section 167 includes a motor and a driver for rotationally driving the fixing roller 133.

The charging roller driving section 168 includes a motor and a driver for rotationally driving the charging roller 123*a*.

The cleaning section 22 includes, as described above, for example, the cleaning roller 24, the cleaning blade 25, and the driving source, not shown, and its driving is controlled by the control section 100.

The registration sensor 63 has: a light emission section which is provided on one side wall side of the conveyance path 190 located upstream of the registration roller 630 in the direction in which the paper is conveyed by the paper conveyance section 411; and a light reception section which is arranged at another side wall part located oppositely to the light emission section and which receives light from this light emission section.

Moreover, the control unit 10 further includes: an abnormal image information reception section 101, a position specification section 102, a cause specification section 103, and an operation control section 104.

The abnormal image information reception section 101 has a function of receiving, based on an operation of the operation section 47 by the user, specification of a position and a kind of an abnormal image appearing on the recording paper on which the image has been formed by the image formation section 12. Specifically, the abnormal image information reception section 101 causes display of the image data, which has been obtained by reading the image with the abnormal image by the document reading section 5, on the LCD of the display section 473. As a result of selecting a position of the image data displayed on the LCD by the user by using a touch panel function of the display section 473, the abnormal image information reception section 101 receives this selected position and specifies the position of the abnormal image appearing on the recording paper on which the image has been formed by the image formation section 12.

Moreover, the abnormal image information reception section 101 causes display of the kind of the abnormal image on the LCD of the display section 473. As a result of selecting the kind of the abnormal image displayed on the LCD by the user by using the touch panel function of the display section 473, the abnormal image information reception section 101 receives this selected kind, and specifies the kind of the abnormal image appearing on the recording paper on which the image has been formed by the image formation section 12.

Moreover, the abnormal image information reception section 101, based on an operation of the operation section 47 by the user, receives information indicating whether or not the appearance of the abnormal image has cyclic nature.

The position specification section 102 acquires information on driving of each of the aforementioned driving sections of the image forming apparatus 1. For example, to a rotary shaft of the photoconductive drum 121, a disc-shaped member is attached in a manner such as to be rotatable concentrically with this rotary shaft. At this disc-shaped member, slits of the same shape are formed in parallel at even intervals, and a photo interrupter (PI) sensor outputs a slit detection signal upon every detection of one of these slits. The position specification section 102, with reference to the signal outputted from the PI sensor, detects how much the photoconductive drum 121 has rotated from its home position.

Moreover, the position specification section 102 reads a current value of the motor of the photoconductive drum driving section 165 or reads a temperature of the motor to acquire information on the driving of the photoconductive drum 121. Similarly, the position specification section 102 monitors the driving roller driving section 164, the secondary transfer roller driving section 162, the primary transfer roller driving section 166, the fixing roller driving section 167, the charging roller driving section 168, etc. to thereby detect driving states of the cylindrical or belt-shaped rotary components such as the charging roller 123*a*, the fixing roller 133, the primary transfer roller 126, the secondary transfer roller 210, the registration roller 630, etc.

Moreover, the position specification section 102 specifies a position of the recording paper moving in the image forming apparatus 1. In the image forming apparatus 1, various sensors including the registration sensor 63 are installed for the aforementioned respective driving sections of the image forming apparatus 1, and the position specification section 102 can refer to signals outputted from the plurality of sensors to specify the position of the recording paper moving in the image forming apparatus 1.

The position specification section 102, with reference to this position of the recording paper and the information of the driving of each of the aforementioned driving sections of the image forming apparatus 1, specify relationship between each potion on the recording paper and a position of each circumferential surface of the photoconductive drum 121, the charging roller 123*a*, the primary transfer roller 126, the secondary transfer roller 210, and the fixing roller 133. For example, the position specification section 102 specifies the position of the circumferential surface of the photoconductive drum 121 abutting a tip part of the recording paper.

In the image memory 32 or the HDD 92, the aforementioned positional relationship and the image data are stored in correspondence with each other. The position specification section 102 performs image analysis on the image data of the image with the abnormal image read at the document reading section 5, and detects the image data corresponding to this image with the abnormal image from among those stored in the image memory 32 or the HDD 92. As a result, the position specification section 102 can specify the relationship between each position on the recording paper, on which the image with the abnormal image has been formed, and the position of each circumferential surface of the photoconductive drum 121, the charging roller 123*a*, the primary transfer roller 126, the secondary transfer roller 210, and the fixing roller 133.

In a case where a plurality of pieces of the same image data have been printed (subjected to image formation), only through image analysis of the image data of the image with the abnormal image read at the document reading section 5, the image data corresponding to this image with the abnormal image cannot be detected from among those stored in the image memory 32 or the HDD 92. Thus, the control section 100 makes the image formation section 12 form, on the recording paper, a predefined identification image in addition to the image of the image data subjected to the image formation.

The position specification section 102, through the image analysis of the image data read at the document reading section 5, can specify presence or absence of the aforementioned identification image and a kind of the identification image. Then the position specification section 102, based on the presence or absence of the identification image and the kind of the identification image, detects the image data corresponding to this image with the abnormal image from those stored in the image memory 32 or the HDD 92.

The cause specification section 103, based on the position and the kind of the abnormal image and the presence or absence of cyclic nature of the appearance of the abnormal image, which have been received by the abnormal image information reception section 101, specifies a cause of the appearance of the abnormal image. Stored in the HDD 92 is information associating the position and the kind of the abnormal image and the presence or absence of cyclic nature of the appearance of the abnormal image with the kind of the driving section of the image forming apparatus 1 causing the appearance of the abnormal image. The cause specification section 103, with reference to this information, specifies the kind of the driving section of the image forming apparatus 1 causing the appearance of the abnormal image. For example, in a case where a white-striped line appears, the cause specification section 103 specifies that the kind of the driving section of the image forming apparatus 1 causing the appearance of the abnormal image is the developing device 122. Moreover, in a case where a black spot appears cyclically, based on an interval of cycles, the cause specification section 103 specifies the kind of the driving section of the image forming apparatus 1 causing the appearance of the abnormal image.

The cause specification section 103, after specifying the kind of the driving section of the image forming apparatus 1 causing the appearance of the abnormal image, specifies a position in this driving section causing the appearance of the abnormal image. More specifically, based on (1) the position of the abnormal image received by the abnormal image information reception section 101; and (2) the relationship between each position on the recording paper, on which the image with the abnormal image has been formed, and the position of each circumferential surface of the photoconductive drum 121, the charging roller 123*a*, the primary transfer roller 126, the secondary transfer roller 210, and the fixing roller 133, which has been specified by the position specification section 102, the cause specification section 103 specifies the position of circumferential surface of any of the photoconductive drum 121, the charging roller 123*a*, the primary transfer roller 126, the secondary transfer roller 210, and the fixing roller 133, which causes the appearance of the abnormal image.

The operation control section 104 controls the drum cleaning device 127, the cleaning section 22, etc. to cause performance of a predefined cleaning operation in correspondence with the cause specified by the cause specification section 103. More specifically, the operation control section 104, for example, by supplying a large amount of a polishing agent to the position of the circumferential surface which has caused the appearance of the abnormal image and which has been specified by the cause specification section 103, causes performance of cleaning of this position of the circumferential surface with greater cleaning power than cleaning power adopted in a normal cleaning operation.

Next, operations of the image forming apparatus 1 provided with the aforementioned configuration will be described. FIG. 3 is a flowchart showing a flow of processing of specifying the position causing the appearance of the abnormal image in the image forming apparatus 1.

Figure 4:
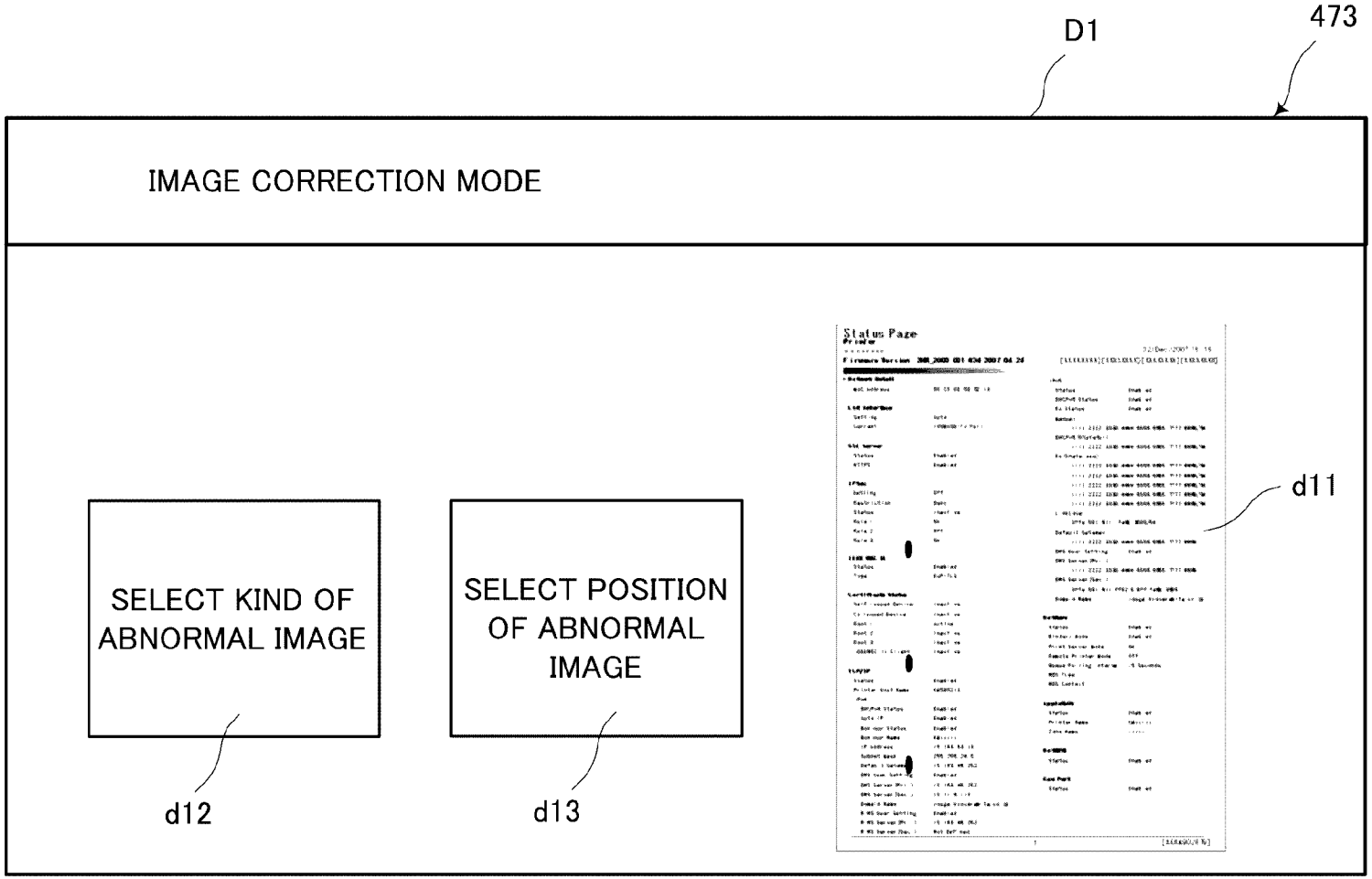
FIG. 4 is a diagram showing one example of a setting screen including image data of a document with the abnormal image.

As shown in FIG. 3, the abnormal image information reception section 101 causes, on the LCD of the display section 473, display of the setting screen including the image data of the document with the abnormal image read at the document reading section 5 (step S10). FIG. 4 shows one example of the setting screen displayed in step S10. As shown in FIG. 4, provided on the setting screen D1 are: a display column d11 which displays the image data of the document with the abnormal image read at the document reading section 5, a button d12, and a button d13.

Figure 5:
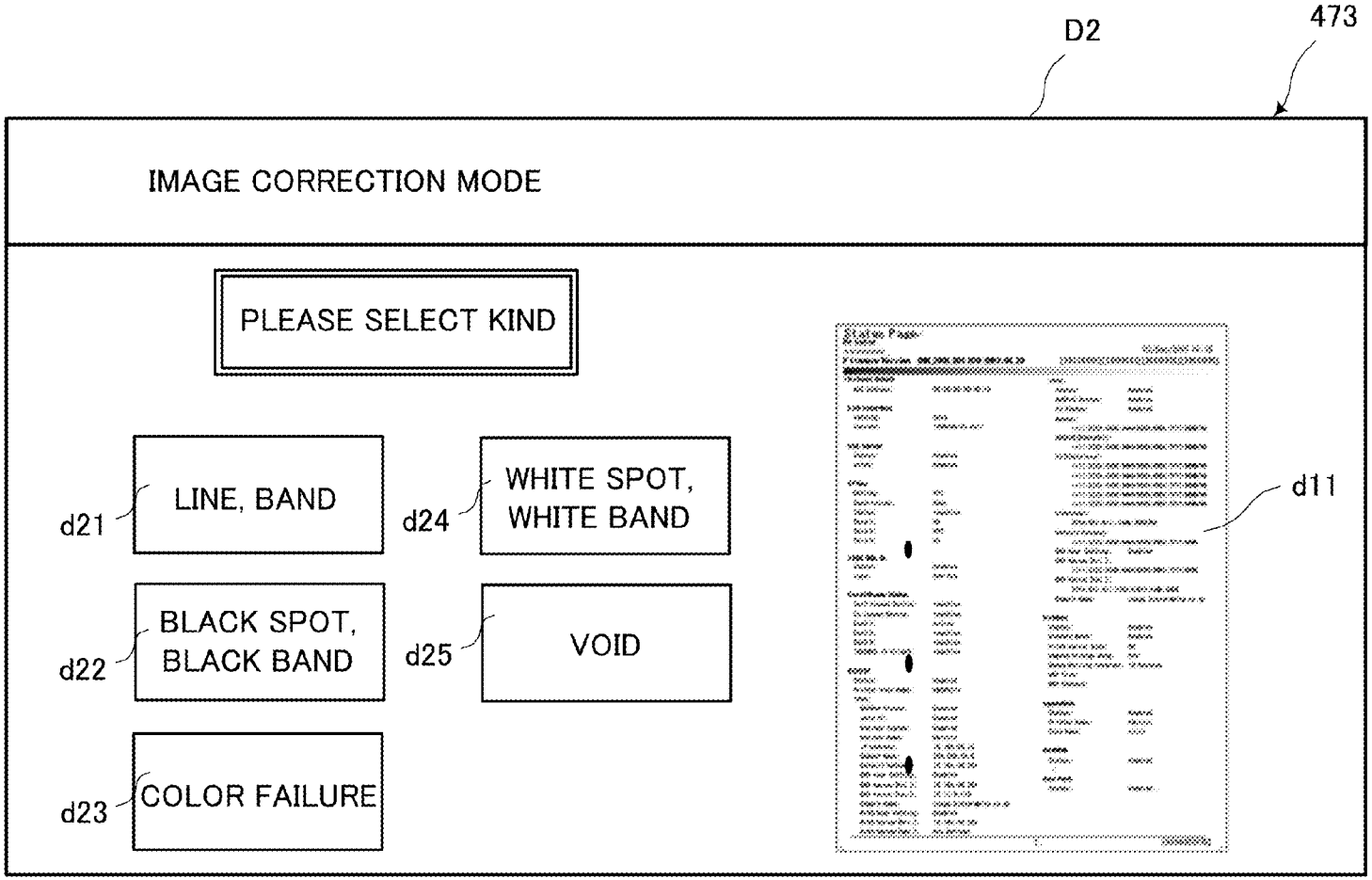
FIG. 5 is a diagram showing one example of a setting screen for receiving a kind of the abnormal image.

The abnormal image information reception section 101, based on an operation of the operation section 47 by the user, receives the specification of the position and the kind of the abnormal image (step S11). More specifically, upon selection of the button d12 on the setting screen D1 shown in FIG. 4 based on the operation of the operation section 47 by the user, the abnormal image information reception section 101 causes display of a setting screen D2 shown in FIG. 5 on the LCD of the display section 473. Then the abnormal image information reception section 101, based on an operation of the display section 473 by the user, receives the specification of the kind of the abnormal image. Provided on the setting screen D2 are five kinds including: "line, band", "black spot, black band", "color failure", "white spot, white band", and "void". Based on an operation of the operation section 47 by the user, upon selection of any of buttons d21 to d25, the abnormal image information reception section 101 receives the kind of the abnormal image. If the abnormal image information reception section 101 has received a plurality of positions of the abnormal image from the user, the abnormal image information reception section 101 stores the number of these positions of the abnormal image.

Figure 6:
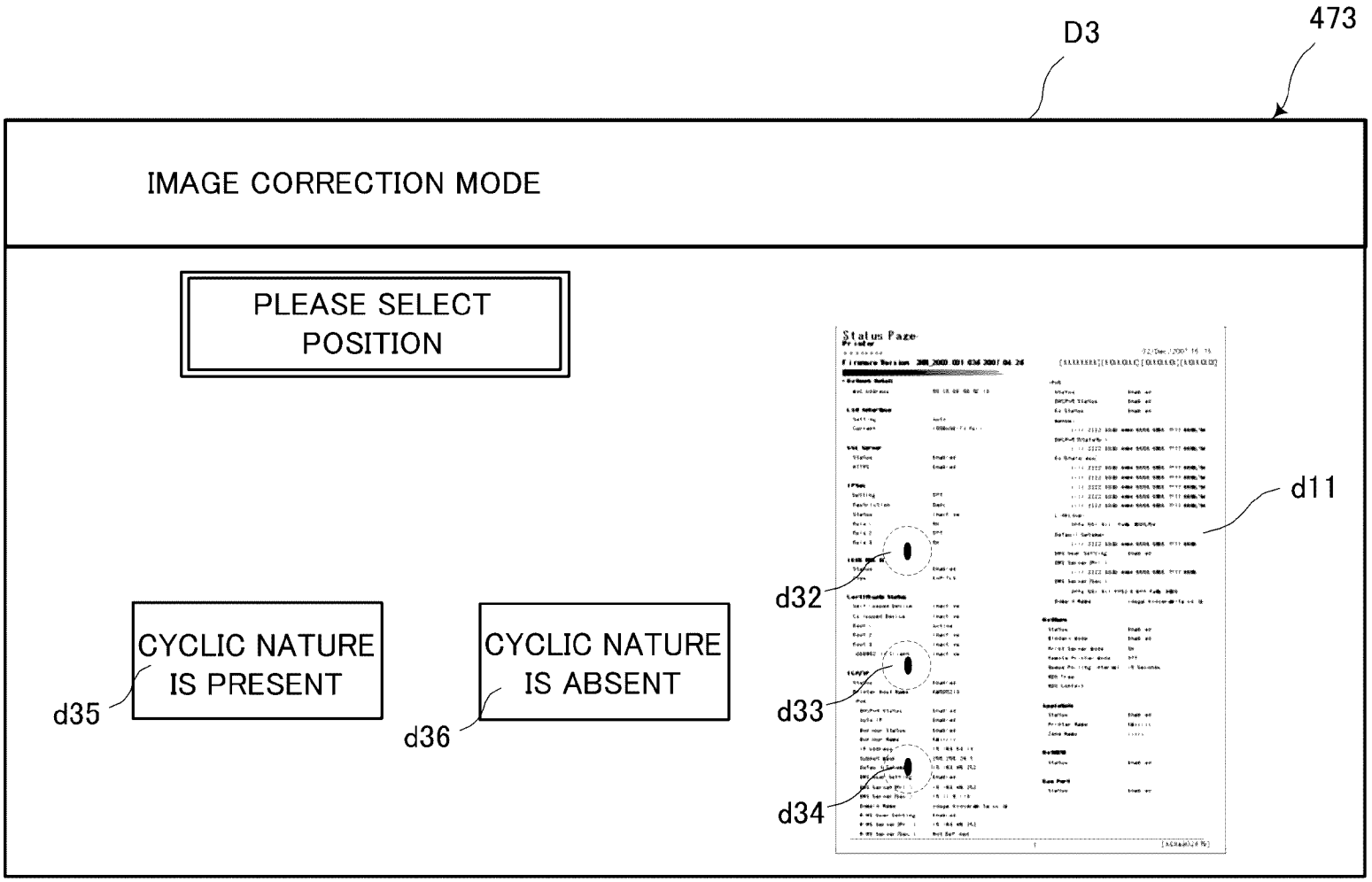
FIG. 6 is a diagram showing one example of a setting screen for receiving a position of the abnormal image.

Moreover, if the button d13 on the setting screen D1 shown in FIG. 4 is selected by the user, the abnormal image information reception section 101 causes display of a setting screen D3 shown in FIG. 6 on the LCD of the display section 473. Then the abnormal image information reception section 101, based on an operation of the operation section 47 by the user, receives the specification of the position of the abnormal image from the user. On the setting screen D3, user's touching of the display column d11 displaying the image data of the document with the abnormal image makes it possible to specify a size and the position of the abnormal image. In an example shown in FIG. 6, with dotted circles d32, d33, and d34, the size and the position of the abnormal image are specified.

Moreover, provided on the setting screen D3 are buttons d35 and 36 for selecting whether or not the position where the abnormal image appears has cyclic nature. Based on an operation of the operation section 47 by the user, upon selection of either of these buttons d35 and 36, the abnormal image information reception section 101 receives information indicating whether or not the appearance of the abnormal image has cyclic nature. If the abnormal image information reception section 101 has received the information indicating that the appearance of the abnormal image has cyclic nature, the abnormal image information reception section 101, based on the position of the abnormal image received based on the operation of the operation section 47 by the user, calculates this cyclic nature. Then the abnormal image information reception section 101, by using this calculated cyclic nature, specifies a position of an abnormal image other than the abnormal image received based on the operation of the operation section 47 by the user.

After step S11, the position specification section 102 specifies the relationship between each position on the recording paper on which the image with the abnormal image has been formed and the position of each circumferential surface of the photoconductive drum 121, the charging roller 123*a*, the primary transfer roller 126, the secondary transfer roller 210, and the fixing roller 133 (step S12). This processing has already been described in the description of the configuration of the position specification section 102, and thus its detailed description will be omitted here.

After step S12, the cause specification section 103, based on the position and the kind of the abnormal image and the presence or absence of cyclic nature of the appearance of the abnormal image, which have been received by the abnormal image information reception section 101, specifies a kind of the driving section of the image forming apparatus 1 causing the appearance of the abnormal image (step S13).

After step S13, the cause specification section 103 specifies the position of any of the circumferential surfaces of the photoconductive drum 121, the charging roller 123*a*, the primary transfer roller 126, the secondary transfer roller 210, and the fixing roller 133, which causes the appearance of the abnormal image (step S14). This processing has already been described in the description of the configuration of the cause specification section 103, and thus its detailed description will be omitted here.

Next, processing of specifying and resolving a problem in the image forming apparatus 1 will be described. FIG. 7 is a flowchart showing a flow of the processing of specifying and resolving a problem in the image forming apparatus 1.

As shown in FIG. 7, the control section 100 of the image forming apparatus 1 controls the document reading section 5 to make it read a document with an abnormal image which has been loaded by the user (step S20).

Next, the abnormal image information reception section 101, the position specification section 102, and the cause specification section 103 of the image forming apparatus 1 specify a position causing appearance of the abnormal image (step S21). This processing is the processing described in the flowchart shown in FIG. 3.

Then the operation control section 104 of the image forming apparatus 1 determines whether or not there are a plurality of positions which have caused the appearance of the abnormal image and which have been specified by the processing in step S21 (step S22). The operation control section 104 performs this determination based on the number of the aforementioned positions of the abnormal image stored by the abnormal image information reception section 101.

If there is one position causing the appearance of the abnormal image (NO in step S22), the operation control section 104 controls the drum cleaning device 127, the cleaning section 22, etc. to make them clean the position which has caused the appearance of the abnormal image and which has been specified in the processing of step S21, with greater cleaning power than the cleaning power adopted in the normal cleaning operation (step S23).

For example, in the processing of step S21, if it has been specified that a foreign substance is adhering to the photoconductive drum 121, the operation control section 104 performs control of increasing the amount of polishing of the photoconductive drum 121 more than that in the normal cleaning operation. Moreover, in the processing of step S21, if it has been specified that the fixing roller 133 is the cause, the operation control section 104 performs control of increasing the heat of the heating roller 132 higher than that in the normal practice and control of increasing the pressure of the pressure roller 134 higher than that in the normal practice.

After the cleaning processing of step S23, the control unit 10 of the image forming apparatus 1 controls the image formation section 12 to make it perform image formation of test image data (step S24).

Figure 8:
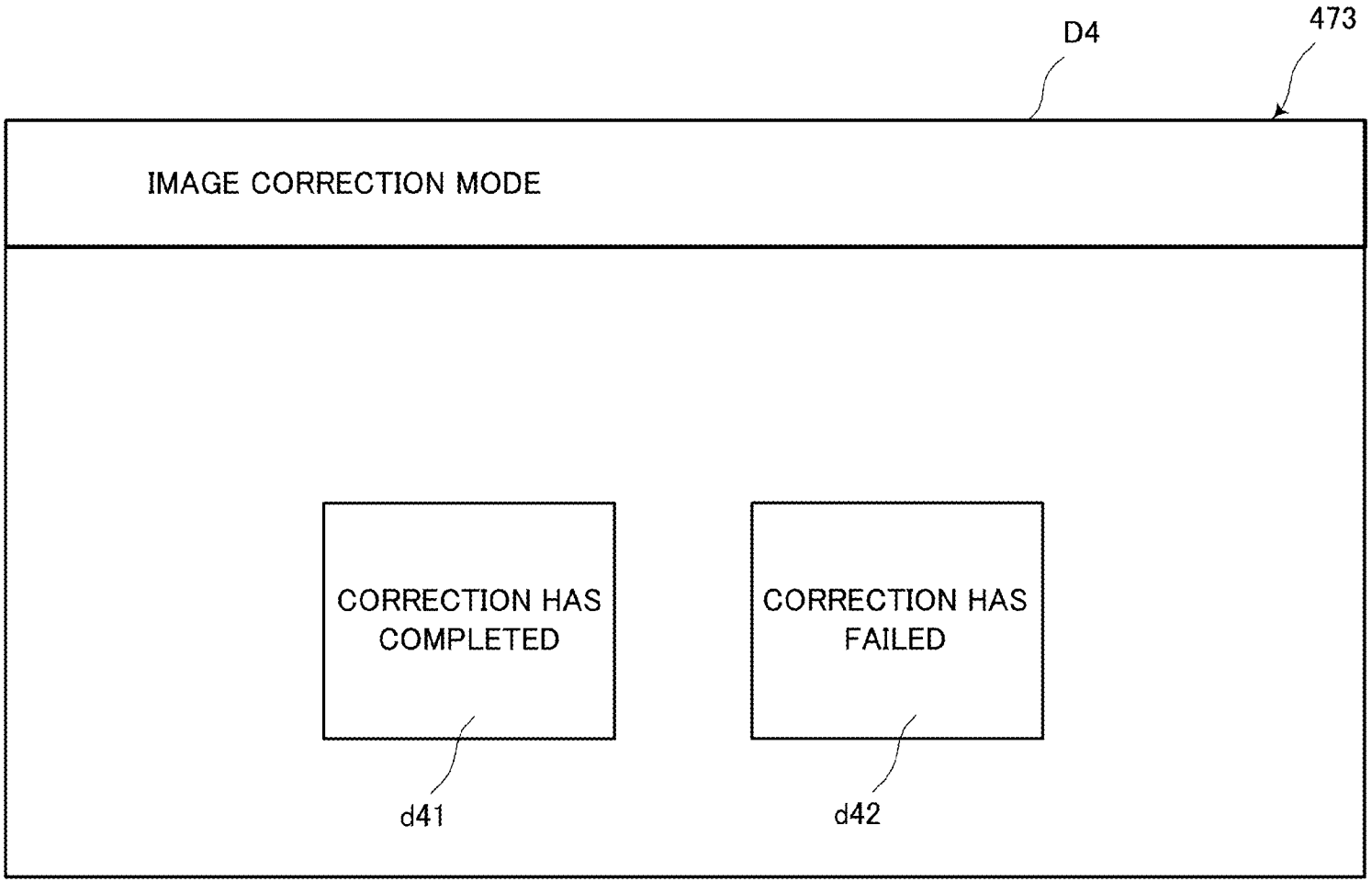
FIG. 8 is a diagram showing one example of a confirmation screen for receiving an instruction indicating that correction of the abnormal image has been completed or has not been completed.

After the image formation of the test image data, the abnormal image information reception section 101 of the image forming apparatus 1 causes display of a confirmation screen on the LCD of the display section 473, and based on an operation of the operation section 47 by the user, receives an instruction indicating that correction of the abnormal image has been completed or has not been completed (step S25). FIG. 8 shows one example of the confirmation screen displayed in step S25. As shown in FIG. 8, buttons d41 and d42 are set on a setting screen D4. Upon selection of either of the buttons d41 or d42 based on an operation of the operation section 47 by the user, the abnormal image information reception section 101 receives the instruction indicating that the correction of the abnormal image has been completed or has not been completed.

If the abnormal image information reception section 101 has received the instruction indicating that the correction of the abnormal image has been completed (YES in step S25), the image forming apparatus 1 ends the processing of specifying and resolving a problem. On the other hand, if the abnormal image information reception section 101 has received an instruction indicating that the correction of the abnormal image is in failure (NO in step S25), the processing returns to step S20.

If there are a plurality of positions causing the appearance of the abnormal image (YES in step S22), the operation control section 104 determines whether or not cleaning has be performed on all the positions (step S26).

If the cleaning has not been completed on all the positions (NO in step S26), the operation control section 104 cleans one of the uncleaned positions, which is located on a most upstream side, with greater cleaning power than that adopted in the normal cleaning operation as a process of the image formation (step S27).

After the cleaning processing of step S27, the control unit 10 of the image forming apparatus 1 controls the image formation section 12 to make it perform image formation of the test image data (step S28).

After the image formation of the test image data, the abnormal image information reception section 101 of the image forming apparatus 1 causes display of the confirmation screen on the LCD of the display section 473, and based on an operation of the operation section 47 by the user, receives an instruction indicating that the correction of the abnormal image has been completed or has not been completed (step S29).

If the abnormal image information reception section 101 has received the instruction indicating that the correction of the abnormal image has been completed (YES in step S29), the image forming apparatus 1 ends the processing of specifying and resolving a problem. On the other hand, if the abnormal image information reception section 101 has received, from the user, the instruction indicating that the correction of the abnormal image is in failure (NO in step S29), the processing returns to step S26. If the cleaning of all the positions by the operation control section 104 has ended (YES in step S26), the processing returns to step S20.

As described above, in the image forming apparatus 1 according to this embodiment, the abnormal image information reception section 101 causes the display of the image data at the display section 473 and also based on the operation of the operation section 47 by the user, receives, from the user, the specification of the position and the kind of the abnormal image appearing on the recording paper on which the image has been formed by the image formation section 12. Then the cause specification section 103, based on the position and the kind of the abnormal image received by the abnormal image information reception section 101, specifies a cause of the appearance of the abnormal image. The operation control section 104 controls the cleaning section cleaning the various driving sections of the image formation section 12 to make it perform a predefined cleaning operation in correspondence with the cause specified by the cause specification section 103. Thus, the image forming apparatus 1 can specify a problem actually felt by the user and also resolve this problem.

For example, with the technology described in the BACKGROUND above, a problem occurring on an outputted image is specified through image analysis performed by the apparatus. Thus, there arises a case where the problem specified by the apparatus does not agree with the problem actually felt by the user. As a result, even in a case where an operation of resolving a problem based on a cause specified by the apparatus is performed, an image wanted by the user may not be obtained. However, according to the embodiments described above, the problem actually felt by the user can be specified to resolve this problem, as described above.

Moreover, the position specification section 102 of the image forming apparatus 1 specifies the relationship between each position on the recording paper and the position of each circumferential surface of the photoconductive drum 121, the charging roller 123*a*, the primary transfer roller 126, the secondary transfer roller 210, and the fixing roller 133. Then based on the aforementioned positional relationship specified by the position specification section 102 and the position and the kind of the abnormal image appearing on the image, which position and kind have been received by the abnormal image information reception section 101, the cause specification section 103 specifies the position of any of the photoconductive drum 121, the charging roller 123*a*, the primary transfer roller 126, the secondary transfer roller 210, and the fixing roller 133 which causes the appearance of the abnormal image. Since the cause of the appearance of the abnormal image is specified based on the position of the recording paper moving in the image forming apparatus 1 and the position on the image inputted by the user where the abnormal image has appeared, an accurate position causing the appearance of the abnormal image in the image forming apparatus 1 can be specified.

Moreover, the operation control section 104 of the image forming apparatus 1 controls the cleaning section to make it clean the position which has caused the appearance of the abnormal image and which has been specified by the cause specification section 103, with greater cleaning power than that adopted in the normal cleaning operation. As a result, for example, a foreign substance causing the appearance of the abnormal image can be deleted to resolve the problem.

Moreover, if there is a plurality of positions which have caused the appearance of the abnormal image and which have been specified by the cause specification section 103, the operation control section 104 of the image forming apparatus 1 controls the cleaning section to make it perform a cleaning operation for each of the positions. Then upon every end of the cleaning operation of one position, the abnormal image information reception section 101 makes the image formation section 12 perform an image formation operation and also based on an operation of the operation section 47 by the user, receives the instruction indicating that the abnormal image has been resolved or has not been resolved. As a result, in a case where there are a plurality of positions causing the appearance of the abnormal image, the position actually causing it can be specified.

Moreover, in the embodiment described above, in a case where there are a plurality of positions causing the appearance of the abnormal image, starting with one of those uncleaned positions which is located on the most upstream side, the aforementioned cleaning is performed as the process of image formation, and thus if the abnormal image has appeared since presence of this position has adverse effect on the different position which has caused the appearance of the abnormal image and which is located downstream of the aforemetnioend position in the process of image formation, possibility that the abnormal image disappears increases even without performing cleaning on this different position located downstream.

This disclosure is not limited to the configuration of the embodiment described above and thus various modifications can be made thereto.

For example, by storing, in a memory, a program including written procedures of the technique described in the embodiment above, reading the program from the memory such as the CPU, and executing the read program, the aforementioned technique may be realized. Further, the program including the written procedures of this technique may be stored in a recording medium and then distributed.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

an image formation section performing image formation of image data, and having a photoconductive drum, a charging roller, and a transfer roller;

a fixing section having a fixing roller;

a position specification section specifying relationship between each position on a recording paper on which an image has been formed by the image formation section and a position of each circumferential surface of the photoconductive drum, the charging roller, the transfer roller, and the fixing roller;

a display section displaying the image data an abnormal image information reception section causing display of the image data at an operation section and also receiving, from a user, specification of a position and a kind of an abnormal image appearing on the recording paper;

a cause specification section specifying a cause of the appearance of the abnormal image based on the position and the kind of the abnormal image received by the abnormal image information reception section;

a cleaning section cleaning each driving section of the image formation section; and an operation control section making the cleaning section perform a predefined cleaning operation in correspondence with the cause specified by the cause specification section, wherein the cause specification section, based on the positional relationship specified by the position specification section and the position and the kind of the abnormal image appearing on the abnormal image which position and kind have been received by the abnormal image information reception section, specifies a position of any of the photoconductive drum, the charging roller, the transfer roller, and the fixing roller, which causes the appearance of the abnormal image, and the operation control section makes the cleaning section perform an operation of cleaning, with greater cleaning power than cleaning power adopted in a normal cleaning operation, the position which has caused the appearance of the abnormal image and which has been specified by the cause specification section.

2. The image forming apparatus according to claim 1, wherein, in a case where there are a plurality of positions which have caused the appearance of the abnormal image and which have been specified by the cause specification section, the operation control section makes the cleaning section perform the cleaning operation for each of the positions, the image formation section, upon every end of the cleaning operation of one of the positions, forms a test image for confirming whether or not the abnormal image has been resolved, upon every formation of the test image by the image formation section, the abnormal image information reception section receives, from the user, an instruction indicating that the abnormal image has been resolved or has not been resolved, and upon reception, from the user, of the instruction indicating that the abnormal image has been resolved by the abnormal image information reception section, the operation control section makes the image formation section cancel the cleaning operation on the uncleaned different position causing the appearance of the abnormal image.

3. The image forming apparatus according to claim 2, wherein, in a case where there are a plurality of positions which have caused the appearance of the abnormal image and which have been specified by the cause specification section, the operation control section makes the cleaning section sequentially perform a cleaning operation for each of the positions starting with the one located on a most upstream side as a process of the image formation, and the operation control section, upon reception, from the user, the instruction indicating that the abnormal image has been resolved by the abnormal image information reception section, makes the image formation section cancel the cleaning operation on the uncleaned different position causing the appearance of the abnormal image.

* * * * *